United States Patent [19]

Desmarais

[11] 4,440,992

[45] Apr. 3, 1984

[54] LOW PROFILE KEYBOARD SWITCH ACTUATING ASSEMBLY

[75] Inventor: Mark R. Desmarais, Derry, N.H.

[73] Assignee: AMP Incorporated, Harrisburg, Pa.

[21] Appl. No.: 508,647

[22] Filed: Jun. 28, 1983

Related U.S. Application Data

[63] Continuation of Ser. No. 354,319, Mar. 3, 1982, abandoned.

[51] Int. Cl.[3] ..... H01H 3/12

[52] U.S. Cl. ..... 200/340; 200/159 B; 200/5 A

[58] Field of Search ..... 200/5 A, 340, 159 B, 200/153 J, 160, 318, 320, 159 R; 400/477, 479, 479.1, 479.2, 491.2

[56] References Cited

U.S. PATENT DOCUMENTS

| | | | |
|---|---|---|---|
| 2,938,985 | 5/1960 | Brantingson | 200/159 R |
| 3,773,997 | 11/1973 | Evans et al. | 200/159 B |
| 3,777,090 | 12/1973 | Muller | 200/159 B |
| 3,780,237 | 12/1973 | Seeger, Jr. et al. | 200/5 A |
| 3,829,646 | 8/1974 | Lorteije | 200/159 B |
| 3,856,998 | 12/1974 | Sims | 200/5 A |
| 4,001,535 | 1/1977 | Scott | 200/340 |
| 4,123,641 | 10/1978 | Murata | 200/340 |
| 4,129,758 | 12/1978 | Gilano et al. | 200/5 A |
| 4,367,384 | 1/1983 | Waarlé | 200/159 B |
| 4,417,115 | 11/1983 | Desmarais et al. | 200/340 |

FOREIGN PATENT DOCUMENTS

| | | | |
|---|---|---|---|
| 266970 | 12/1968 | Austria | 200/340 |
| 25629 | 3/1981 | European Pat. Off. | 200/159 B |

*Primary Examiner*—Stephen Marcus
*Assistant Examiner*—Ernest G. Cusick
*Attorney, Agent, or Firm*—F. W. Raring

[57] ABSTRACT

Low profile switch actuating assembly comprises a frame, a plunger slidably mounted in the frame, and a key top on the force-receiving end of the plunger. The underside of the key top has a frame-receiving recess therein which receives the upper end of the frame when the plunger is depressed. The force-receiving end of the plunger has radially extending arms which are also received in the frame-receiving recess and which have their outer ends received in arm-receiving recesses in the underside of the key top. The upper end of the frame has arm-receiving slots which receive portions of the arms that are adjacent the plunger axis. The plunger can be assembled to the key top and to the frame in any one of four angular orientations, if required.

4 Claims, 7 Drawing Figures

2

Fig. 2
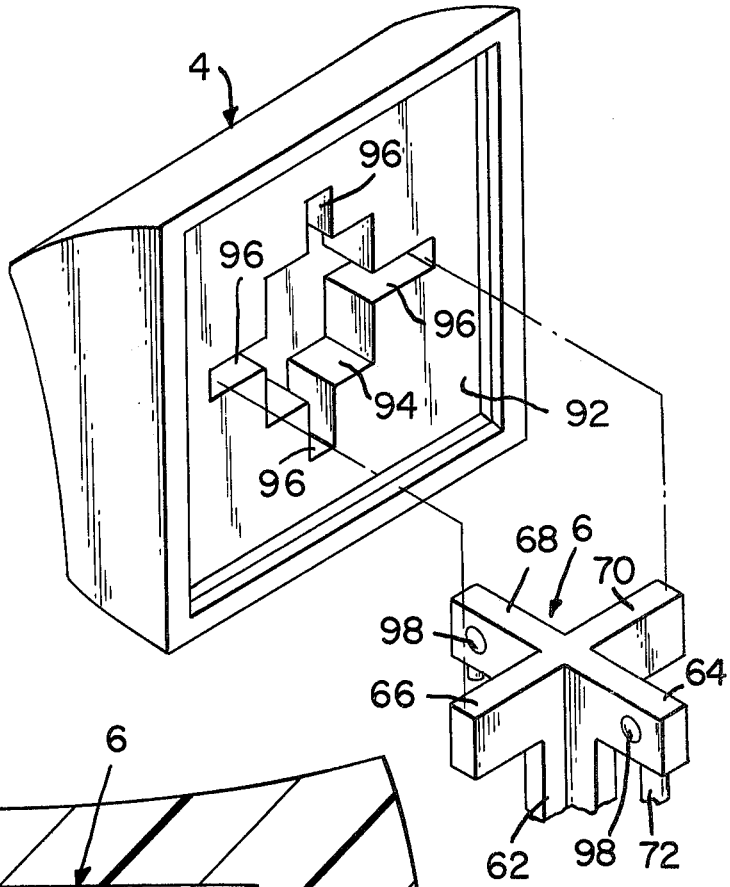
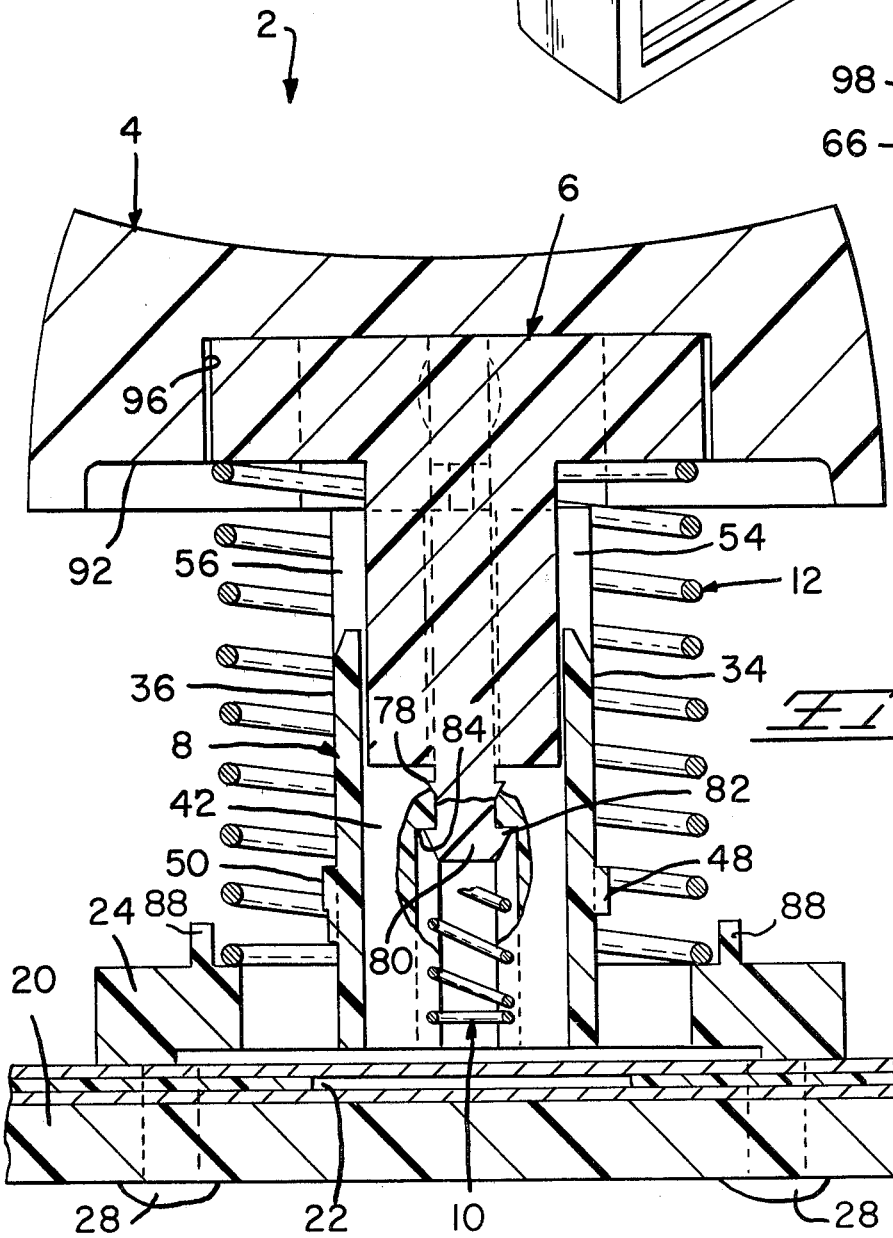
Fig. 5

2
4
5
6
7
8
10
12
14
16
18
20
22
24
26
28
42
44
46
62
72
74
76
78
80
82
84
86
90
92
96
98

LOW PROFILE KEYBOARD SWITCH ACTUATING ASSEMBLY

This is a continuation, of application Ser. No. 354,319, filed Mar. 3, 1982, now abandoned.

FIELD OF THE INVENTION

This invention relates to switch actuating assemblies for closing membrane or other type switches on a keyboard. The invention is particularly directed to the achievement of an actuating assembly which has a reduced height and which provides a relatively long stroke where required.

The invention is further directed to the achievement of a switch actuating assembly having a plunger which can be assembled to the key top and to the frame in any one of a plurality of angular orientations.

BACKGROUND OF THE INVENTION

A conventional keyboard such as an alpha numeric keyboard of the type having membrane or other type switch for each key position, has a switch actuator at each key position which comprises, in general, a fixed frame, a plunger slideably mounted in the frame, and a key top secured to the upper or force-receiving end of the plunger. When the key top is pressed, the plunger is moved downwardly and effects closure of the switch. Keyboard switches for alpha numeric keyboards are constructed and designed such that their dimensions will conform to industry accepted standards so that all keyboards will be similar to each other to the extent that the operators will be able to use keyboards from different manufacturers.

The older keyboards were usually provided with switch actuators that have a somewhat greater overall height than is permitted by the standards that are being followed at present and which will apply to many keyboards manufactured in the future. The newer standards, commonly referred to as DIN Standards, specify the dimensions, the slope of the keyboard, and the stroke required for the key positions in a manner such that many presently available keyboards cannot be brought into conformity with the standards. When designing a keyboard which will satisfy the DIN standards, it is desirable to have switch actuators of a reduced overall height, as compared with previously known actuators and which have a relatively long stroke, notwithstanding the reduced overall height of the actuator. The present invention in accordance with one aspect thereof, is directed to the achievement of an actuator which will meet these requirements of a long stroke coupled with reduced height.

The invention is further directed to the achievement of an actuator comprising a frame, a plunger, and a key top with the plunger being capable of assembly to the frame and to the key top in any one of several angular orientations. This feature is advantageous in certain types of actuators that are designed to provide for different operating modes with standard parts, as explained for example, in U.S. application Ser. No. 354,318, now U.S. Pat. No. 4,417,115 filed on the same date as this application.

A low profile switch actuating assembly in accordance with the invention comprises a frame having a fixed end and a free end and having an axial opening extending into the free end towards the fixed end. A plunger is slidably mounted in the opening, the plunger having a lower end which is proximate to the fixed end of the frame and a force-receiving end which is proximate to the free end of the frame. The plunger is slideably movable from a normal position to a depressed position, the force-receiving end of the plunger being located beyond the free end of the frame when the plunger is in the normal position and being movable towards the free end when the plunger is moved to the depressed position. The force-receiving end of the plunger has a key top thereon which is pressed to move the plunger to the depressed position. A switch actuating assembly in accordance with the invention is particularly characterized in that the key top has an underside which is opposed to the free end of the frame and a frame-receiving recess is provided in the underside, the recess being dimensioned to receive the free end of the frame upon movement of the key top towards the frame. The force-receiving end of the plunger has a plurality of radially extending arms integral therewith, the arms being in the plane which extends normally of the axis of the plunger. The force-receiving end of the plunger is received in the underside of the key top with adjacent portions of the arms, which are adjacent to the axis of the plunger, being in the force-receiving recess and with outer end portions of the arms being received in arm-receiving recesses. The arm-receiving recesses extend from the sidewalls of the frame-receiving recess. The free end of the frame has arm-receiving slots therein extending radially from the axial opening, the arm-receiving slots being dimensioned to receive the adjacent portions of the plunger arms whereby upon movement of the plunger from the normal position to the depressed position, the free end of the frame is received in the frame-receiving recess and the adjacent portions of the plunger arms enter the arm-receiving slots.

In accordance with a further embodiment, an actuator in accordance with the invention is characterized in that the plunger arms extend from the plunger at equally spaced angular intervals and the arm-receiving recesses and the arm-receiving slots extend at the same angular intervals as the plunger arms. The plunger is capable of assembly to the frame in at least two different angular orientations. In accordance with a further embodiment, the plunger has four plunger arms which are secured in the arm-receiving recesses of the key top and the switch actuating assembly is mounted on a membrane switch which is closed when the plunger is moved to its depressed position.

DESCRIPTION OF THE DRAWINGS

FIG. 2 is a perspective view of the upper portion of the plunger and the key top with the key top exploded from the plunger and oriented such that its underside is visible.

FIGS. 5, 6 and 7 are views taken along the lines 5—5, 6—6, and 7—7 of FIG. 3.

PREFERRED EMBODIMENT OF THE INVENTION

Figures 3, 4:
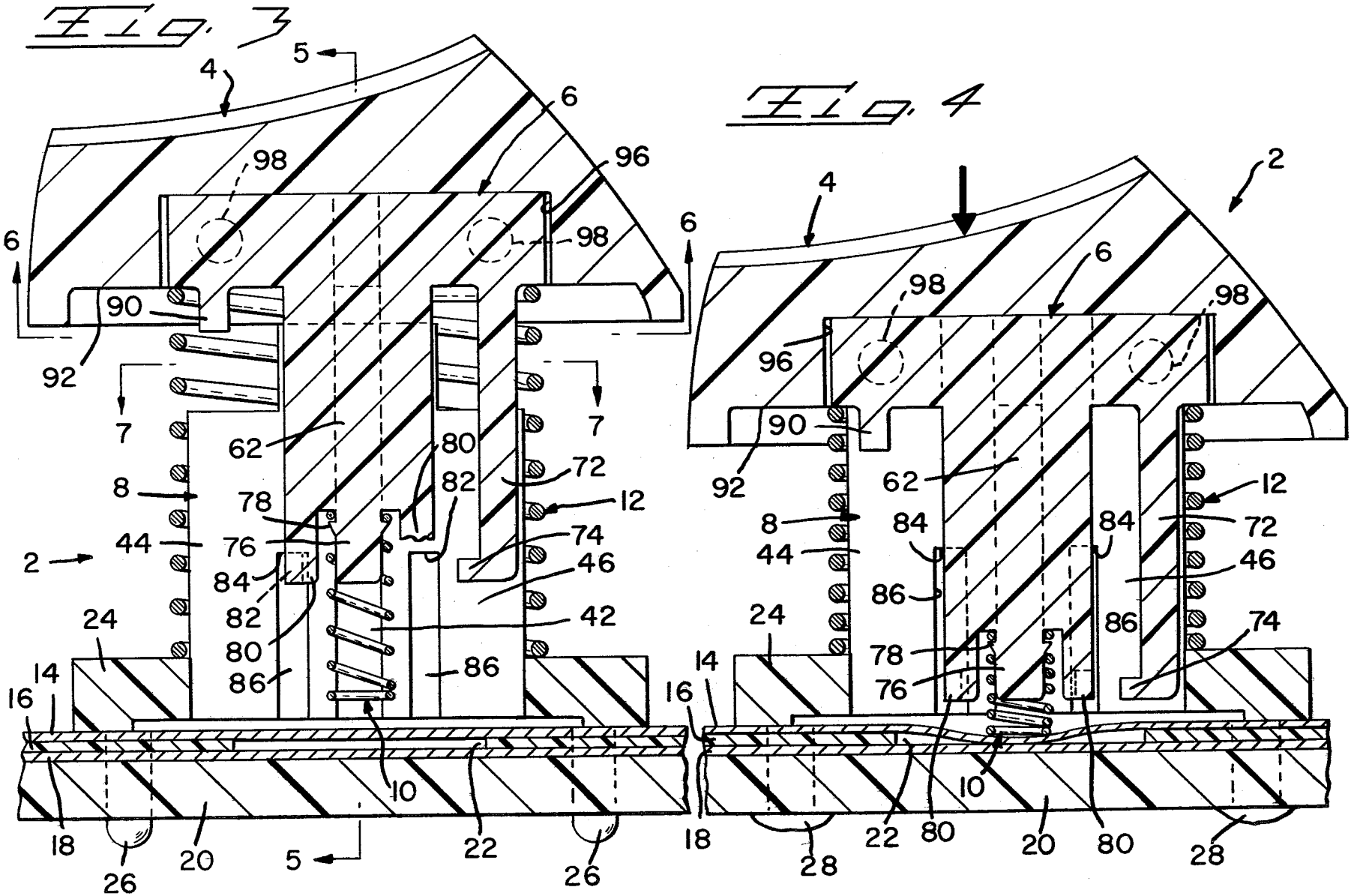
FIG. 3 is a cross-sectional view of an actuator assembly mounted on a panel above a membrane switch, this view showing the positions of the parts when the plunger is in its normal position.
FIG. 4 is a view similar to FIG. 3 showing the positions of the parts when the plunger is in its depressed position.

Referring to FIGS. 1–5, the switch actuator assembly 2 in accordance with the invention comprises a key top 4, a plunger 6, a frame 8, an actuator spring 10, and a return spring 12. The assembly as shown in FIG. 3 is mounted above a membrane switch comprising an upper membrane 14, a separator 16, and a lower membrane 18. A hole 22 is provided in the separator 16 so that when the upper membrane is flexed toward the lower membrane as shown in FIG. 4, switch contacts on the upper membrane are pressed against switch contacts on the lower membrane. The membrane switch is mounted on a panel 20 by means of mounting members 26 which are integral with a base 24. The mounting members extend through openings in the membrane switch and in the panel and are flattened as shown at 28 to retain the frame on the panel. The frame with the integral base 24 and the plunger 6 are each molded as one piece parts.

Figure 7:
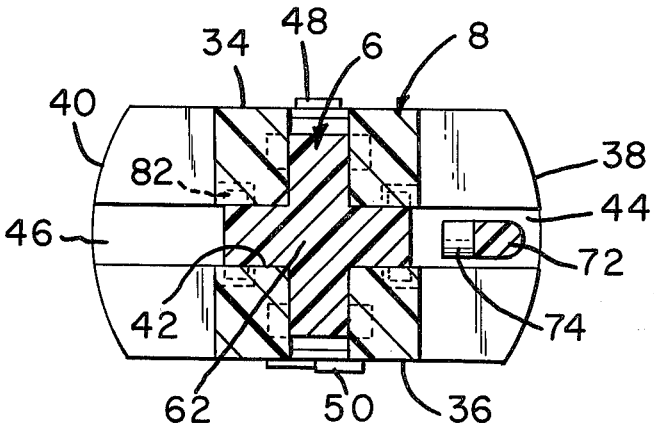

The frame 8 has a lower or fixed end 30 and an upper or free end 32. The frame has parallel oppositely facing flat sidewalls 34, 36 and oppositely facing arcuate sidewalls 38, 40, see FIG. 7. An axial opening 42 extends through the frame from the free end to the fixed end and, in addition, openings 44, 46 extend into the sidewalls 38, 40 to the axial opening 42. An integral cam 48, FIG. 7, is provided on the flat sidewall 34 and a cam 50 is provided on the sidewall 36. The upper portion of the frame has upwardly directed shoulders 52 and the free end portion 32 comprises a cluster of four column-like projections which surround the axial opening 42. Arm-receiving slots 54, 56 extend from the axial opening to the sidewalls 34, 36 and the upper portions 58, 60 of the openings 44, 46 also serve as arm-receiving slots. These slots receive portions of plunger arms which are described below.

The plunger 6 has a cruciform guide portion 62 which conforms to, and is slideable in, the axial opening 42, as shown in FIG. 7. The upper end, or the force-receiving end, of the plunger has four integral radially extending arms 64, 66, 68, 70 which are spaced at 90° angular intervals. A camming arm 72 extends downwardly from the arm 64 and has an inwardly directed cam follower 74 on its lower end.

Figure 1:
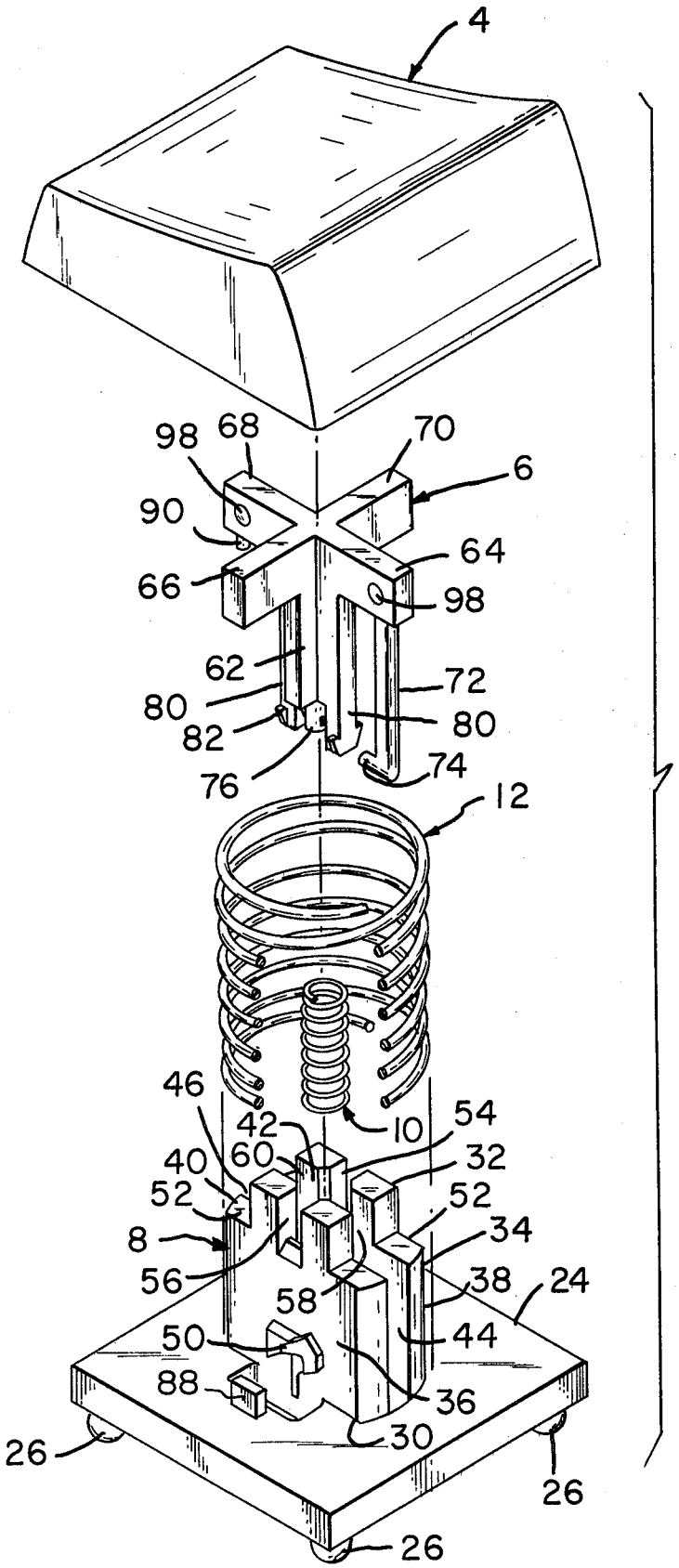
FIG. 1 is a perspective view of the parts of a switch actuator assembly with the parts exploded from, and in alignment with, each other.

If the plunger 6 is assembled to the frame 8 while in the orientation shown in FIG. 1, the camming arm 72 is received in the opening 44 and no camming effect is obtained when the plunger is depressed. As will be explained below, the plunger 6 can be assembled to the frame when it is rotated 90° in a clockwise direction, or a counter-clockwise direction from the position shown in FIG. 1. If the plunger is rotated clockwise 90° from the position of FIG. 1 prior to assembly to the frame, the cam follower 74 will cooperate with the cam 50 to provide a shift-lock effect in the actuator. If the plunger is rotated 90° in a counter-clockwise direction, the cam follower will cooperate with the cam 48 to provide a tactile effect to the operator when the plunger is depressed. These features of the actuator are more fully explained in the above identified application U.S. Pat. No. 4,417,115.

The lower end of the plunger has a cylindrical axial projection 76 having outwardly extending retaining ears 78 thereon which serve to retain the actuator spring 10 on the projection, as shown in FIG. 3. The lower end of this spring engages the membrane 14, as shown in FIG. 4, when the plunger is depressed. The plunger is retained in assembled relationship to the frame by outwardly directed shoulders 82 on the ends of the extensions 80 which are on opposite sides of the cylindrical projection 76. The shoulders 82 lodge behind downwardly facing shoulders 84 at the ends of grooves 86 in the axial opening 42, see FIGS. 4 and 5.

The return spring 12 is retained in assembled relationship as shown in FIGS. 3 and 4 by retaining ears 88 which extend upwardly from the base 24 and a retainer 90 which depends from the underside of the plurality arm 68. The camming arm 72 also serves to position and retain the return spring as shown in FIG. 3.

Figure 6:
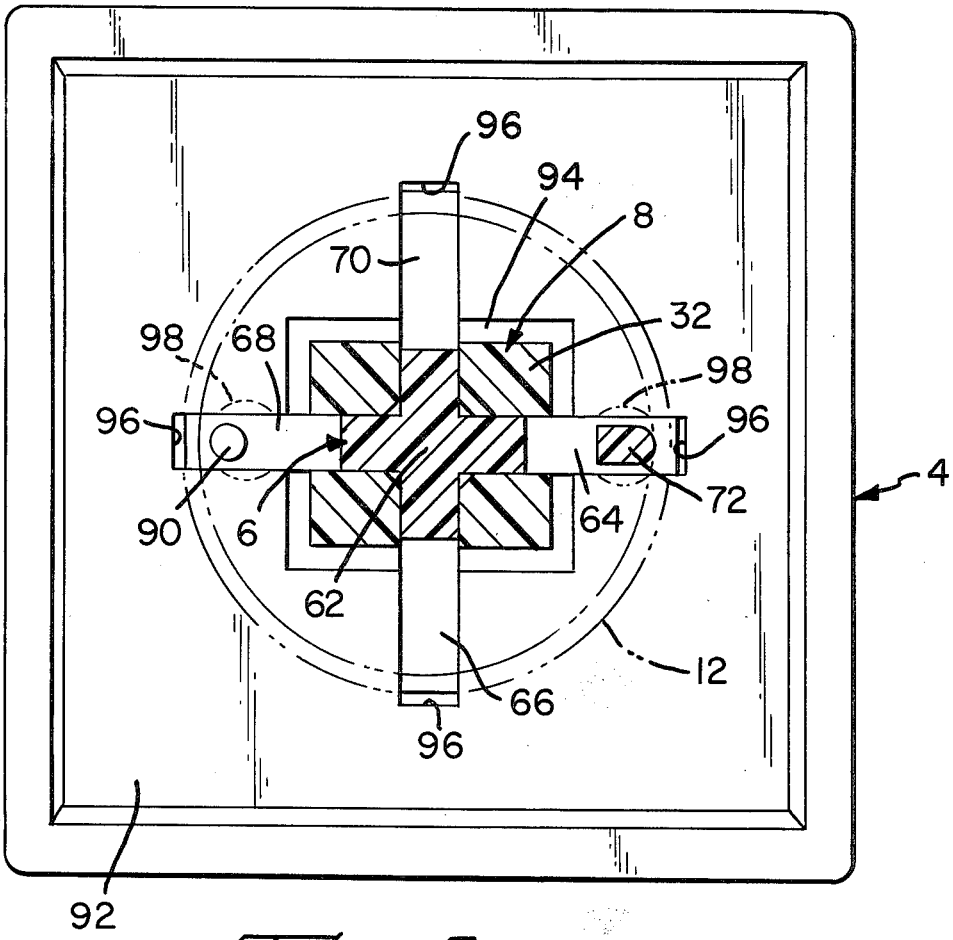

The key top 4 has an underside 92, see FIGS. 2 and 6, in which there is provided a square frame-receiving recess 94 that receives the upper free end 32 of the frame. Arm-receiving recesses 96 extend from the sidewalls of the frame-receiving recess and are dimensioned to receive the outer end portions of the plunger arms 64 and 70. Two or more of the arms may be provided with integral bosses 98 to bring about an interference fit of the outer ends of the arms in the recesses 96.

The parts shown in FIG. 1 are assembled by assembling the plunger 6 to the key top 4, mounting the spring 10 on the projection 76 and then positioning the return spring 12 on the surface 24. The key top and plunger are then assembled to the frame by moving the guide portions 62 of the plunger into the opening 42 until the shoulders 82 are below the shoulders 84. In use, when the upper surface by the key top is pressed by the operator, the plunger will be moved downwardly from the positions of FIGS. 3 and 5 to the position of FIG. 4. During such movement, adjacent portions of the plunger arms 64–70, which are adjacent to the plunger axis, will be received in the arm-receiving recesses 54, 56, 58, 60 and the free end 32 of the frame will be received in the frame-receiving recess 94 of the key top, see FIG. 6. The substantial overlap of the underside of the key top and the free end portion 32 of the frame permits the key top to move relatively closer to the fixed end of the frame than otherwise would be possible. At the same time, there is not any sacrifice in the length of the stroke of the plunger and a variety of actuators can be designed in accordance with the principles of the invention which will satisfy the more recent DIN specifications.

One embodiment of the invention has been designed in which the overall height of the assembly to the key top is 20.3 mm and the stroke can be up to 3.8 mm as required. These dimensions compare with previous actuators which had heights in the range of 38 mm to 43 mm.

An advantageous feature of the invention is that the radially extending arms on the plunger projection across the underside of the key top and key top is therefore supported in a stable manner on the force receiving end of the plunger. In other words, there is no tendency for the key top to wobble when it is pressed.

The low profile and relatively long stroke is achieved in the disclosed embodiment along with the feature of being able to assemble the plunger 6 to the key top in different orientations as explained above. This feature of the invention is of importance in some actuators, such as the actuator claimed in U.S. Pat. No. 4,417,115, where different operating modes are achieved depending upon the orientation of the plunger in the frame.

What is claimed is:

1. A low profile switch actuating assembly comprising a frame having a fixed end and a free end, an axial opening extending into the free end towards the fixed end, a plunger in the opening, the plunger having a lower end which is proximate to the fixed end of the frame and a force-receiving end which is proximate to the free end of the frame, the plunger being slidably movable into the frame from a normal position to a depressed position, the force-receiving end of the plunger being located beyond the free end of the frame when the plunger is in the normal position and being movable towards the free end when the plunger is moved to the depressed position, the force-receiving end of the plunger having a key top thereon which is pressed to move the plunger to the depressed position, the switch actuating assembly being characterized in that:

the free end of the frame has a plurality of angularly spaced slots extending therethrough from the axial opening, the force-receiving end of the plunger has a plurality of radially extending arms extending therefrom, the arms being in alignment with the slots in the frame, the arms having adjacent portions, which are adjacent to the axis of the plunger and which are dimensioned to be freely received in the slots, the arms having outer end portions which are remote from the axis of the plunger, the key top has an underside which is opposed to the free end of the frame, a frame-receiving recess is provided in the underside which is dimensioned to receive the free end of the frame, a plurality of arm-receiving recesses extend radially from the frame-receiving recess, the force-receiving end of the plunger and the adjacent portions of the arms being in the frame-receiving recess, the outer end portions of the arms being received in, and secured in, the arm-receiving recesses whereby, upon movement of the plunger from the normal position to the depressed position, the free end of the frame enters the frame-receiving recess and the adjacent portions of the plunger arms enter the arm-receiving slots.

2. A low profile switch actuating assembly as set forth in claim 1 characterized in that the plunger arms extend from the plunger at equally spaced angular intervals, the arm-receiving recesses and the arm-receiving slots extending at the same angular intervals as the plunger arms, the plunger being capable of assembly to the frame in at least two angular orientations.

3. A low profile switch actuating assembly as set forth in claim 2 characterized in that the plunger has four plunger arms extending therefrom.

4. A low profile switch actuating assembly as set forth in claim 3 characterized in that the actuating assembly is mounted on a membrane switch which is closed when the plunger is moved to the depressed position.

* * * * *